US006139323A

United States Patent [19]

Christians et al.

[11] Patent Number: 6,139,323

[45] Date of Patent: Oct. 31, 2000

[54] WEAPON EFFECT SIMULATION METHOD AND APPLIANCE TO PERFORM THIS METHOD

[75] Inventors: Ernst Christians, Henstedt-Ulzburg; Wilfried Goda; Ralf Kauffeldt, both of Hamburg; Jan Marek, Elmshorn, all of Germany

[73] Assignee: C.O.E.L. Entwicklungsgesellschaft mbH, Wedel, Germany

[21] Appl. No.: 09/086,986

[22] Filed: May 29, 1998

[30] Foreign Application Priority Data

Jul. 10, 1997 [DE] Germany ..... 197 29 475

[51] Int. Cl.[7] ..... F41A 33/00

[52] U.S. Cl. ..... 434/16; 434/11; 434/22

[58] Field of Search ..... 434/11, 16, 19, 434/20, 22; 463/5, 50, 52; 446/473

[56] References Cited

U.S. PATENT DOCUMENTS

| | | | |
|---|---|---|---|
| 4,342,556 | 8/1982 | Hasse | 434/22 |
| 4,373,916 | 2/1983 | Ashford | 434/22 |
| 4,487,583 | 12/1984 | Brucker | 434/22 |
| 4,545,583 | 10/1985 | Pearman | 463/5 |
| 4,576,481 | 3/1986 | Hansen | 356/375 |
| 4,695,058 | 9/1987 | Carter | 463/5 |
| 4,695,256 | 9/1987 | Eichweber | 434/22 |
| 4,781,593 | 11/1988 | Birge | 434/22 |
| 4,854,595 | 8/1989 | Eichweber | 463/5 |
| 4,959,016 | 9/1990 | Lawrence | 434/22 |
| 4,963,096 | 10/1990 | Khattack | 434/21 |
| 5,591,032 | 1/1997 | Powell | 434/22 |
| 5,636,992 | 6/1997 | Mastrangelo | 434/21 |
| 5,690,491 | 11/1997 | Fitzgerald | 434/16 |
| 5,716,216 | 2/1998 | O'Loughlin | 434/22 |
| 5,788,500 | 8/1998 | Gerber | 434/22 |
| 5,816,817 | 10/1998 | Tsang | 434/22 |

FOREIGN PATENT DOCUMENTS

| | | |
|---|---|---|
| 22 62 605 | 7/1973 | Germany . |
| 32 34 949 C1 | 12/1983 | Germany . |

*Primary Examiner*—Robert A. Hafer
*Assistant Examiner*—Kurt Fernstrom
*Attorney, Agent, or Firm*—Hill & Simpson

[57] ABSTRACT

The present invention pertains to an optical weapon effect simulation method for training of soldiers at least at two different weapons, whereas each weapon is equipped as an attacking as well as a target system. The attacking system has a laser pulse transmitter and measurement unit attached to the weapon which transmits laser signals with at least two different wavelengths $\lambda_1$, $\lambda_2$ and detects the appropriate signal reflections. The target system is provided with at least one retro-reflector with integrated selective filter, optical receiver with selective filter and evaluation electronics. Only laser pulses of a defined wavelength are reflected or accepted by the target system. Inherent errors resulting from reflections caused by numerous targets which cannot be separated and the falsification of target positions are eliminated. Target types are identified by the attacker based upon a wavelength of laser signal received.

9 Claims, 2 Drawing Sheets

FIG. 5A
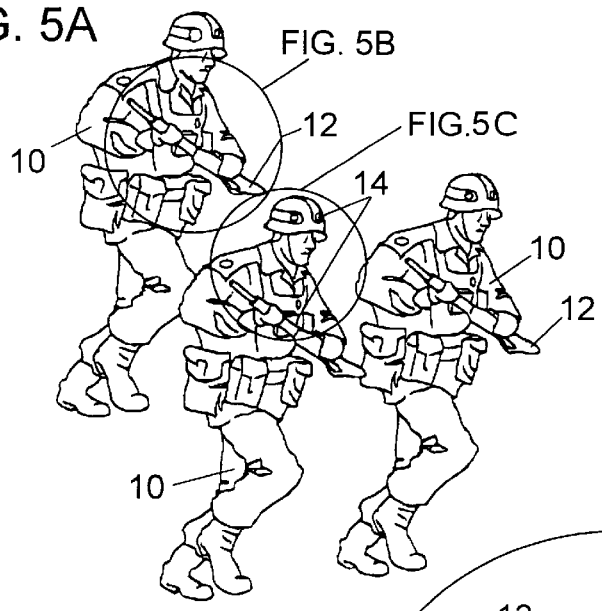
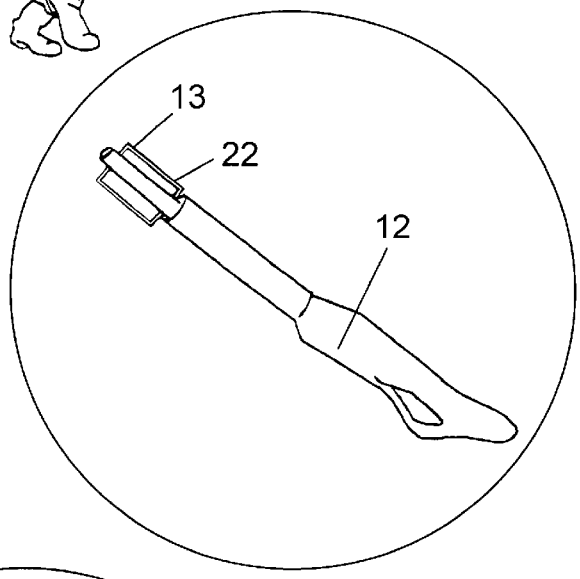
FIG. 5B
FIG. 5C
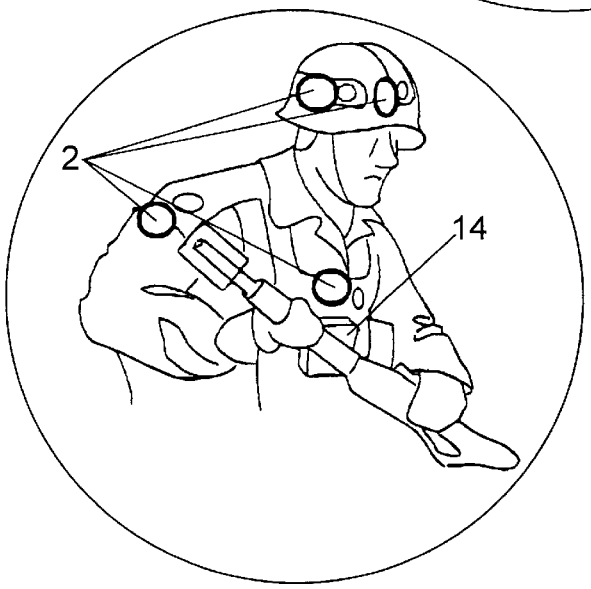

WEAPON EFFECT SIMULATION METHOD AND APPLIANCE TO PERFORM THIS METHOD

BACKGROUND OF THE INVENTION

The present invention pertains to a method for weapon effect simulation an appliance to carry out this method according to the generic term for training at least two participants with direct aimed weapons with pulsed laser beams, whereby each participant is provided with an attacking system and a target system. The attacking system has a laser pulse transmitter and a laser pulse receiver and the target system has a retro-reflector.

A similar appliance has been published in DE-PS 32 34 949. From this patent specification an appliance is known which simulates gun fire among exercise participants by using firstly a laser transmitter attached to the weapon which, during simulated firing, sends laser pulses to determine the position of the target object, secondly an optical receiver to detect laser pulses reflected by the target and thirdly an evaluation unit to obtain the hit or miss result which then is transmitted to the target by coded laser pulses from the above described transmitter. When acting as target the above described appliance is equipped with reflector elements for laser pulses as well as with at least one optical receiver and decoder for receiving coded laser pulses and for acquiring the hit or miss information contained within, whereby the reflector elements and optical receivers are distinct devices located at a certain distance to each other.

A similar gunnery simulator is known from DE-PS 22 62 605. In that patent it is demonstrated how, by optical transmission of the impact result data of the "attacker" and by consideration of the "target's" self protection, a realistic scenario is being set up, which facilitates the simulated combat of combined weapons.

Modern equipped armies use laser simulators in marksmanship training and force-on-force training for direct firing weapons. Known laser simulators make use of pulsed laser sources. For technical reasons, and in order to be compatible to simulators already in use, all present laser simulators work at a wavelength of approximately $\lambda$=900 nm. GaAs solid state laser diodes are preferred. Within all efficient laser shot simulators each participant is attacker and target at the same time and is equipped with retro-reflectors in addition to his weapon simulator. Surveying of retro-reflectors which act as a reference for the target's position and the data link from attacker to target is achieved by pulsed laser sources. The laser simulator of the attacking system can precisely calculate in advance the position of the simulated round in the target plane; this is made possible because factors which influence the point of penetration, like the target's distance and speed, can be measured with eye-safe laser pulses. Adding data of further sensors to this, influences like the attacking weapon's tilt, the ballistics, the time of flight of the round or missile, the superelevation and lead, the gunner's aiming quality and so on can be taken into account to calculate the point of penetration.

From the technology used by even the most efficient laser shot simulators developed and introduced so far emerges the following: On the one hand, for the target's simulation system many data from the attacker (type, ammunition, target distance, etc.) are known which are transmitted optically during engagement and so here, while considering their own vulnerability, the effect can be determined. On the other hand and as a severe drawback, the attacking system only has information about the position of one or several of the target's reflectors.

For a comprehensive training of soldiers under realistic conditions it is necessary to exercise participants from different arms of the service like infantry, armored infantry and tank corps jointly. All exercise participants have to be provided with laser shot simulators. Particularly when infantry takes part in such training, by the great number of reflectors, one might get an excessive amount of reflexes to laser ranging signals, which could make an exact evaluation impossible. It cannot be avoided that sometimes infantrymen, with their reflectors, are positioned on or close to their vehicles accidentally or intentionally, which causes the simulator of the attacking system to use a falsified target position for its calculations, or eventually even prevents several targets from being properly engaged. Thus, the exercise participant is trained a simulation specific attitude and it is doubtful whether the training aims can be achieved.

SUMMARY OF THE INVENTION

An object of the present invention is to develop further a method under the generic term "weapon effect simulation" and an appliance under that same generic term in such a way that more data are made available at the attacking system, enabling it to distinguish targets and groups of targets in terms of their type.

This task is performed by using a method and appliance under the generic term weapon effect simulation with a laser pulse transmitter at the attacking system with which pulsed laser beams of at least two different wavelengths can be transmitted wherein a selected one out of the at least two different wavelengths is received at the laser pulse receiver. The pulsed laser beams of different wavelengths can be emitted simultaneously, in succession or interlaced. The retro-reflector of the target system may have an active or passive selective filter attached to it or it may have an active or passive selective coating on at least one of its reflecting planes or surfaces, so that only selective wavelengths are reflected. The laser pulse receiver at the laser pulse transmitter may have an active or passive selective filter attached to it, so that only selective wavelengths are received at the laser pulse receiver. A spectrum analyzer or coupling device may be employed to analyze the pulsed laser beams and to permit blocking or transmitting selected wavelengths according to a spectral analysis of received laser beams.

By selecting different wavelengths ($\lambda_1\lambda_2$) of the emitted and/or received pulsed laser beams, a distinction between participants or groups of participants and special installations (pyrotechnical units, shelters, etc.) is possible. Even target systems which originally have worked without retro-reflectors can be integrated into the system.

Besides the GaAs solid state laser diodes used presently for laser shot simulators, for other technical tasks pulsed and CW-laser diodes are manufactured which emit at a wavelength different from $\lambda$ approx.=900 nm. The combination of lasers of different wavelengths (including tuneable ones) and passive and active selective filters (edge-, band-pass or adaptive, e.g. piezo controlled, filters) for target surveying or distinction is proposed within this invention. The selective filters can either be attached in front of the retro-reflectors or can be integrated into the same. Specific selective filters can also be integrated into the laser pulse transmitters. It is to be considered that with retro-reflectors of different construction (e.g. solid glass or hollow), by the choice of material (type of glass, e.g., quartz or colored glass; metal; plastic), by coating, by additional filters and by further measures, a selection of reflected laser pulses is possible within a wide spectral range.

The transmitted laser beams get registered at the target. If an additional analysis of the wavelength is performed, the measurement can be controlled with the help of active elements (e.g., tuneable interference filters) or in a simpler way by mechanical devices, which let laser beams pass through the filter or block them depending on the wavelength and so a selective measurement is made possible.

A measure, which in a simple way shows the advantages of the method proposed in the present invention, is to provide the infantrymen equipment with reflectors comprising a selective filter which will only let pass wavelength $\lambda_1$. All weapon effect simulators which threaten the infantry (e.g., rifle, automatic gun, machine gun) are equipped in such a way that they perform the target survey and hit evaluation with a laser at wavelength $\lambda_1$. Other weapon effect simulators (e.g. for MBT guns) ignore the infantry for, according to the present invention, these systems use a different wavelength $A_2$. Therefore mutual interference and deception of these systems are impossible.

According to the present invention, by the selective system and by the combination of lasers it is possible to distinguish participants or groups of participants or installations, that is, at the attacking system as well as at the target system.

In addition, even if many participants are accumulated it is possible to transmit a specific information only to one selected participant or to a certain group of participants or only to a special installation, even if an optical and/or geometrical separation of these participants is not possible.

Certain messages which are only meant for a group of participants are transmitted using a specific wavelength.

A general exchange of data among the participating systems takes place with the help of a shared wavelength of, e.g., approx. 900 nm, independently of the specific wavelength used for surveying.

BRIEF DESCRIPTION OF THE DRAWINGS

FIG. 5A schematically illustrates infantry training participants carrying laser short simulators and wearing target systems and retro-reflectors.

FIG. 5B is an enlarged schematic view of the laser shot simulator shown in FIG. 5A in the form of a weapon with a laser pulse transmitter.

FIG. 5C is an enlarged schematic view of the retro-reflectors shown in FIG. 5A, on the training participant.

DETAILED DESCRIPTION OF THE PREFERRED EMBODIMENTS

Figure 1:
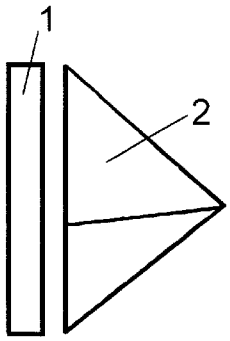
FIG. 1 is schematically illustrates a retro-reflector with a selective filter.

The present invention provides a method for weapon effect simulation and an appliance to carry out this method. As shown in FIG. 5A, at least two participant's 10 in the form of infantrymen are provided with direct aimed weapons 12 for producing pulsed laser beam of at least two different wavelengths from a laser pulse transmitter 13. Each participant 10 is provided with an attacking system comprising the weapon 12 and a target system 14 comprising one or more retro-reflector 2.

Figure 6A:
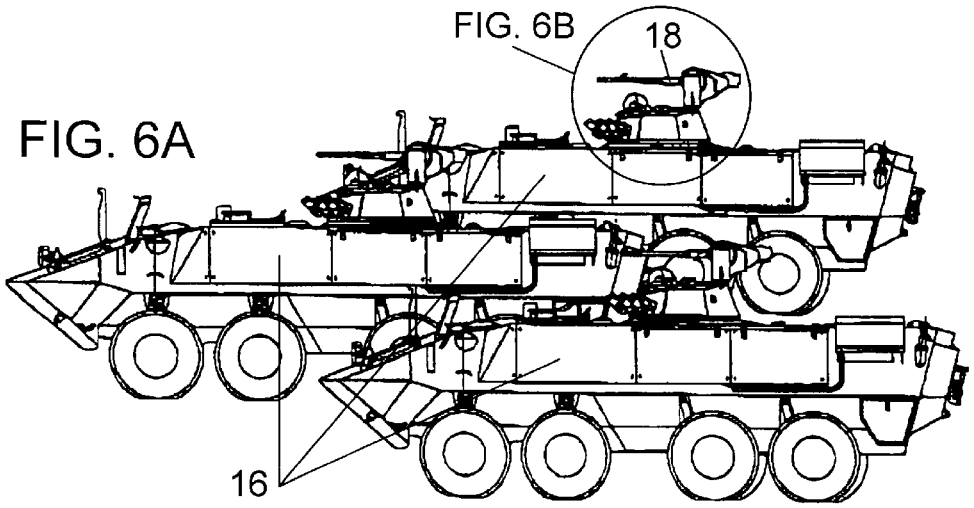
FIG. 6A schematically illustrates vehicle training participants carrying laser shot simulators, target simulators and retro-reflectors.
Figure 6B:
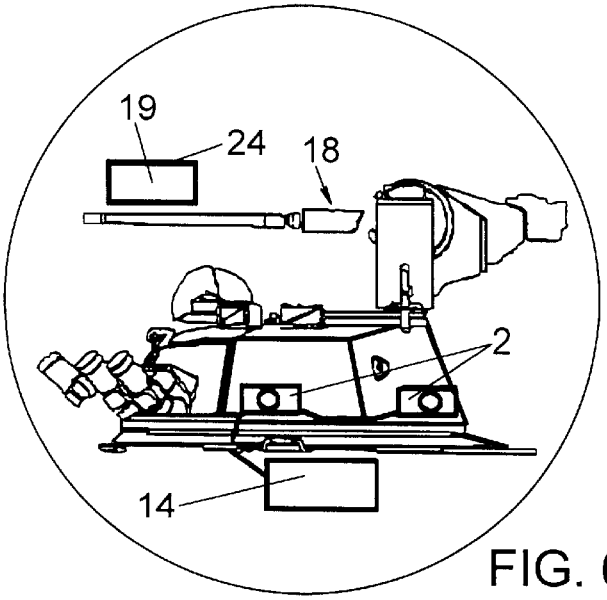
FIG. 6B is an enlarged schematic view of the laser shot simulator, target simulator and retro-reflector of FIG. 6A.

FIG. 6A illustrates several participants in the form of vehicles 16 with direct aimed weapons 18 having laser pulse transmitters 19 for transmitting pulse beam of at least two different wavelengths and a target system 20 which includes a retro-reflector 2.

The attacking system 12, 18 transmits pulse laser beams of at least two different wavelengths and a selected one of the at least two different wavelengths is received at the laser pulse receiver 22, 24. The pulse laser beam of different wavelengths can be emitted simultaneously, in succession or interlaced. The retro-reflector 2 of the target system 14, 20 may have an active or passive selective filter attached to or it may have an active or passive selective coating on at least one of its reflecting planes for surfaces, so that only selected wavelengths are reflected. This is discussed in detail below.

The laser pulse receiver 22, 24 at the least pulse transmitter 13, 19 may have an active or passive selected filter attached to it, so that only selective wavelengths are received at the laser pulse receiver. A spectrum analyzer of coupling device may be employed to analyze the pulsed laser beam and to permit blocking or transmitting selected wavelengths according to a spectral analysis of laser beams.

By selecting different wavelengths ($\lambda_1\lambda_2$) of the emitted and/or received pulsed laser beams, a distinction between participants 10, 16 or groups of participants and special installations (pyrotechnical units, shelters, etc.) is possible. Even target systems which originally have worked without retro-reflectors can be integrated into the system.

Besides the GaAs solid state laser diodes used presently for laser shot simulators, for other technical tasks pulsed and CW-laser diodes are manufactured which emit at a wavelength different from $\lambda$ approx.=900 nm. The combination of lasers of different wavelengths (including tuneable ones) and passive and active selective filters (edge-, band-pass or adaptive, e.g. piezo controlled, filters) for target surveying or distinction is proposed within this invention. The selective filters can either be attached in front of the retro-reflectors or can be integrated into the same. Specific selective filters can also be integrated into the laser pulse transmitters. It is to be considered that with retro-reflectors of different construction (e.g. solid glass or hollow), by the choice of material (type of glass, e.g., quartz or colored glass; metal; plastic), by coating, by additional filters and by further measures, a selection of reflected laser pulses is possible within a wide spectral range.

The transmitted laser beams get registered at the target 14, 20. If an additional analysis of the wavelength is performed, the measurement can be controlled with the help of active elements (e.g., tuneable interference filters) or in a simpler way by mechanical devices, which let laser beams pass through the filter or block them depending on the wavelength and so a selective measurement is made possible.

A measure, which in a simple way shows the advantages of the method proposed in the present invention, is to provide the infantrymen equipment with reflectors 2 comprising a selective filter which will only let pass wavelength $\lambda_1$. All weapon effect simulators which threaten the infantry 10, (e.g., rifle, automatic gun, machine gun) are equipped in such a way that they perform the target survey and hit evaluation with a laser at wavelength $\lambda_1$. Other weapon effect simulators (e.g. for MBT guns) ignore the infantry 10 for, according to the present invention, these systems use a different wavelength $A_2$. Therefore mutual interference and deception of these systems are impossible.

According to the present invention, by the selective system and by the combination of lasers it is possible to distinguish participants or groups of participants or installations, that is, at the attacking system 12, 18 as well as at the target system 14, 20.

In addition, even if many participants are accumulated it is possible to transmit a specific information only to one selected participant or to a certain group of participants or only to a special installation, even if an optical and/or geometrical separation of these participants is not possible.

Certain messages which are only meant for a group of participants are transmitted using a specific wavelength.

A general exchange of data among the participating systems takes place with the help of a shared wavelength of, e.g., approx. 900 nm, independently of the specific wavelength used for surveying.

The specifics of preferred embodiments of the retro-reflectors 2 are described as follows:

FIG. 1 shows a known retro-reflector 2 which is formed either as a solid or hollow body. A selective filter 1 is fitted in front of retro-reflector 2. This selective filter 1 is fitted in front of retro-reflector 2. This selective filter 1, as an edge filter, lets pass a range of wavelength or, as a band-pass filter, lets pass a selected wavelength.

Figure 2:
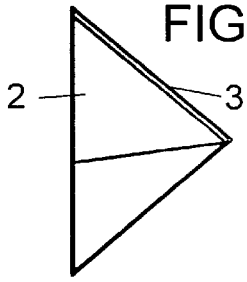
FIG. 2 displays a retro-reflector with selective coating on one surface.

FIG. 2 illustrates retro-reflector 2 in a different arrangement which has a selective coating on one of its sides. Selective coating 3 can be active or passive and so lets pass beams of a certain wavelength or reflects them. In this case, the body of the retro-reflector 2 can either be a solid or a hollow body.

Figure 3:
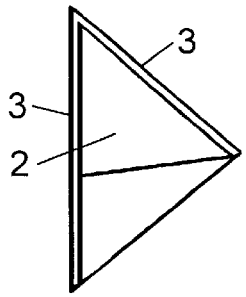
FIG. 3 presents a retro-reflector with selective coating on two surfaces.

FIG. 3 shows a solid body retro-reflector 2 which has a selective coating 3 on two sides.

Figure 4:
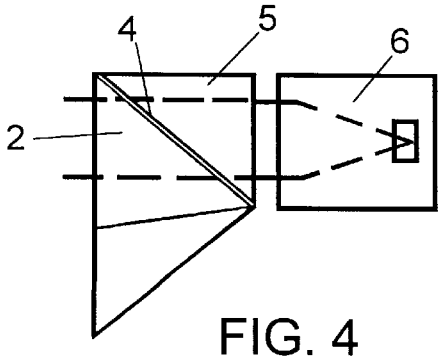
FIG. 4 displays a retro-reflector with an attached receiver.

FIG. 4 shows a retro-reflector 2 which is connected with a coupling device 5, e.g., a right angle prism. This coupling device 5 has a selective layer 4. More surfaces with different selective coatings can be used as well. Only beams with a selected wavelength penetrate through the coupling device and are analyzed in a following spectrum analyzer or coupling device receiver 6. The beams coupled out may, if necessary, also be registered by detectors which react selectively.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

We claim as our invention:

1. A weapon effect simulation method for the training of at least two participants with direct aimed weapons with pulsed laser beams, comprising the steps:

equipping each participant with an attacking system and a target system;

providing each attacking system with a weapon, a laser pulse transmitter attached to said attacking system with which pulsed laser beams of at least two different wavelengths can be transmitted, and a laser pulse receiver;

connecting at least one retro-reflector to each target system;

transmitting pulsed laser beams from said laser pulse transmitter to at least one of said retro-reflectors of said target system;

reflecting at least a part of said pulsed laser beams from said retro-reflector to said laser pulse receiver at said attacking system;

using said pulsed laser beam to survey a distance between said attacking and said target systems, a position, speed and heading of said target system and to transmit information to said target system; and receiving a selected one out of said at least two different wavelengths of said pulsed laser beam at said laser pulse receiver.

2. A weapon effect simulation method according to claim 1, wherein said step of receiving a selected one of said wavelength is accomplished by transmitting only said selected one wavelength from said laser pulse transmitter.

3. A weapon effect simulation method according to claim 1, wherein said step of receiving a selected one of said wavelength is accomplished by filtering said pulsed laser beam at one of said retro-reflector and said laser pulse receiver.

4. A weapon effect simulation method according to claim 1, wherein said step of receiving a selected one of said wavelength is accomplished by reflecting only a selected wavelength by said retro-reflector by use of a selective coating.

5. A weapon effect simulation method according to claim 1, wherein said laser pulse transmitter transmits laser beams of different wavelengths one of simultaneously, in succession and interlaced.

6. A weapon effect simulation method according to claim 1, wherein said target system includes a spectral analyzer and including the step of spectrally analyzing said received pulsed laser beam by said spectral analyzer.

7. A weapon effect simulation method according to claim 6, wherein said step of receiving a selected one of said wavelength is accomplished by returning only said selected one wavelength from said target system and wherein said step of returning a selected wavelength is controlled according to said spectral analysis of said received laser pulse beams at said target system.

8. A weapon effect simulation appliance for the training of at least two participants with direct aimed weapons with pulsed laser beams, comprising:

an attacking system comprising a weapon, a laser pulse transmitter with which pulsed laser beams of at least two different wavelengths can be transmitted, and a laser pulse receiver;

a target system comprising at least one retro-reflector for reflecting at least a part of said pulsed laser beams from said retro-reflector to said laser pulse receiver at said attacking system;

an evaluation unit for receiving a selected one out of said at least two different wavelengths of said pulsed laser beam at said laser pulse receiver.

9. An appliance according to claim 8, wherein said at least one retro-reflector has one of an active and passive selective filter attached to it.

10. An appliance according to claim 9, wherein said selective filter is one of an edge filter, a band-filter, and a piezo controlled filter.

11. An appliance according to claim 9, wherein said selective filter has a passive selective coating and on at least one of said reflector's reflecting surface there is coupling device which lets pass the pulsed laser beams, and including a following optical receiver which analyzes and registers the laser beams and which controls the blocking or transmission of selected wavelengths.

12. An appliance according to claim 8, wherein said at least one retro-reflector has one of an active and passive selective coating on at least one of its reflecting surfaces.

13. An appliance according to claim 8, wherein said laser pulse receiver has one of an active and passive selective filter attached to it.

14. An appliance according to claim 8, wherein said laser pulse transmitter is coupled with one of at least two selective filters, each of which lets pass one specific range of wavelengths.

* * * * *